US005320354A

United States Patent [19]

Vasquez

[11] Patent Number: 5,320,354

[45] Date of Patent: Jun. 14, 1994

[54] GOLF INSTRUCTIONAL DEVICE FOR CHIPPING PITCHING, OR PUTTING

[76] Inventor: Jose C. Vasquez, 2608 Torrey Pines, Ft. Worth, Tex. 76109

[21] Appl. No.: 27,400

[22] Filed: Mar. 8, 1993

Related U.S. Application Data

[62] Division of Ser. No. 862,880, Apr. 3, 1992, Pat. No. 5,203,568.

[51] Int. Cl.[5] ..... A63B 69/36

[52] U.S. Cl. ..... 273/187.2; 273/189 R

[58] Field of Search ..... 273/187.2, 189 R, 165, 273/166, 162 R, 186.1, 186.2, 187.4, 187.5, 191 R, 192, 194

[56] References Cited

U.S. PATENT DOCUMENTS 2,273,416 2/1942 Norwood ..... 273/35
3,951,416 4/1976 Koch et al. ..... 273/183 B
4,781,382 11/1988 Hargraves ..... 273/183 B
4,944,516 7/1990 Bickler ..... 273/183 B
5,085,437 2/1992 Leitao ..... 273/183 B
5,145,179 9/1992 Breed ..... 273/189
5,163,685 11/1992 Rhodes ..... 273/187.5
5,203,568 4/1993 Vasquez ..... 273/187.2

*Primary Examiner*—George J. Marlo
*Attorney, Agent, or Firm*—Robert A. Felsman; Mark D. Perdue

[57] ABSTRACT

A golfer's aid wherein an elongated support member having a cap at its upper end is held against the grip of a golf club with the cap engaging the upper end of the grip. A single adjustable link extends from the cap at substantially a right angle to the elongated support and terminates at an arm pad which positions the golfer's lower leading arm during pitching and chipping shots.

12 Claims, 2 Drawing Sheets

GOLF INSTRUCTIONAL DEVICE FOR CHIPPING PITCHING, OR PUTTING

This application is a division, of application Ser. No. 07/862,880, filed Apr. 3, 1992, now Pat. No. 5,203,568.

BACKGROUND OF THE INVENTION

1. Field of the Invention

This invention relates to golf instructional or training devices used to improve putting and other strokes around the green.

2. Background Information

The act of putting is arguably the most important process in the game of golf. Normally, half the golfer's score is devoted to the task of putting. Golf courses always allow two strokes on every hole for putting while defining the score of par. Any activity geared towards perfecting the art of putting has enormous effects on a golfer's overall score. All golfers strive for total perfection in this area.

Golf is a game of motion. When a golfer begins play on a golf hole, the objective is clear. The ball must be advanced into a small cup a great distance away. The process of striking the golf ball and carrying it great distances requires a great deal of body motion, but eventually that motion must cease. As the golfer moves closer to the cup, precision in distance and direction must be improved or the goal will not be achieved. Because putting is generally the last swing motion, it is considered the most precise activity.

A number of golf instructional devices have been suggested for the improvement of strokes around the green. Some of them connect a golfer's arm or wrist to the club with a linkage to prevent wrist movement or "breaking" during the stroke. Many of the best putters advocate the use of only the arms during the putting stroke to prevent the errant putts that results from breaking the wrist near the point of impact.

One instructional device is disclosed by Norwood in his U.S. Pat. No. 2,273,416. He used a retaining member that fit against the grip of a golf club to be held by the golfer below the end of the shaft and grip. The retaining member has a pivotable link with an arm or wrist band through a spacer to prevent wrist breakage during a stroke. This device interferes with normal hand position while gripping the club. He uses a strapped pad that creates a static angle that may not be comfortable to different size golfers. Also, the left wrist (of a right hand player) is ignored although it provides all the directional motion involved in a stroke or swing.

A variation of Norwood is disclosed by Bickler in his U.S. Pat. No. 4,944,516 which uses a J-hook shaped member designed to engage a hole found in the top of a standard putter grip. An angled attachment member extends upwardly from the J-hook member to support an arm or wrist guide. This device has the same disadvantages found in Norwood.

Previously known golf instructional devices have focused on only a segment of the putting function. These devices were attached to the putter or engaged the golfer in such a manner as to compromise feel and posture. To use these devices, a golfer must adapt to unusual or unnecessary positions.

For a training device to be helpful it must allow the user to complete the task without constraints, if the task is properly performed. Only when an incorrect action is performed should the user be confronted.

Every golfer has a different approach to putting. The motion is acutely affected by each player's physical characteristics. The ideal instructional device for putting or chipping or pitching is adjustable to enable each golfer to assume a normal putting position. The golfer's normal grip, posture and feel should not be affected by the instructional or trainer device. Yet the overall goal of limiting body motion should be controlled by the design of the device.

The position of the trainer above and beside the putter grip should make it comfortable for the golfer to use during a practice session.

Since travel is a part of the sport and the golfing public is a mobile group, the ideal instructional device should be capable of convenient disassembly and reassembly.

SUMMARY OF THE INVENTION

It is the general object of the invention to provide an improved golf instructional device used as a putter, chipper or pitching training device.

In accordance with this object, my improved golf instructional device has a support member including a cap at its upper end and adapted to be held against a conventional or standard golf club, a coupler is secured between the cap of the support member and a link of selected length. An arm pad is supported on one end of the link to unalterably position at least the lower leading arm relative to the grip and the club. According to a preferred embodiment, a threaded coupler is used at the top of the support member and a threaded bolt is used to support the arm pad to provide a link of adjustable length and for ease of assembly and disassembly.

The above as well as additional objects, features and advantages of the invention will become apparent in the following description.

DESCRIPTION OF THE PREFERRED EMBODIMENT

Figure 1:
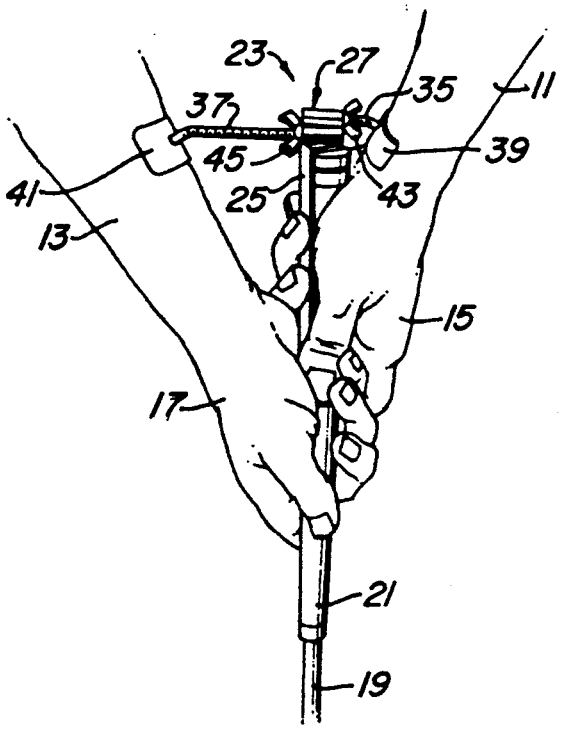
FIG. 1 is a perspective view of a golfer's hands holding a putter and the golf instructional device of the present invention.
Figure 2:
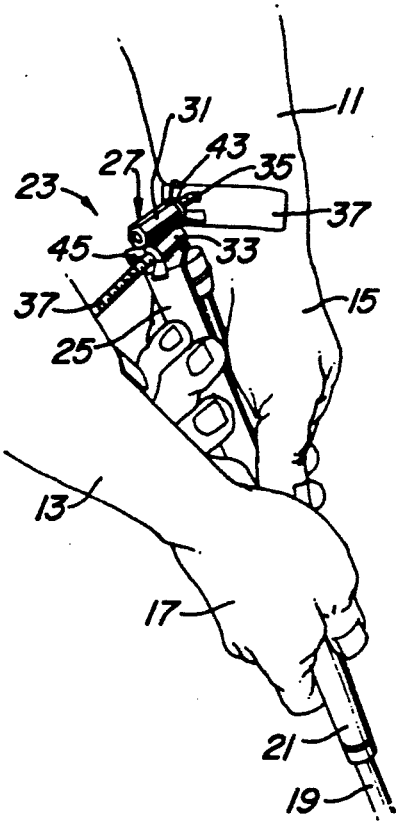
FIG. 2 is a perspective view from a different angle of a golfer's hands holding the golf instructional device of the present invention.

Referring to the drawings, the numerals 11 and 13 in FIGS. 1 and 2 designate the left and right forearms of a golfer holding with hands 15, 17 a golf club 19 and conventional grip 21 and a golf instructional device 23 that is constructed in accordance with the principles of the invention.

Figure 3:
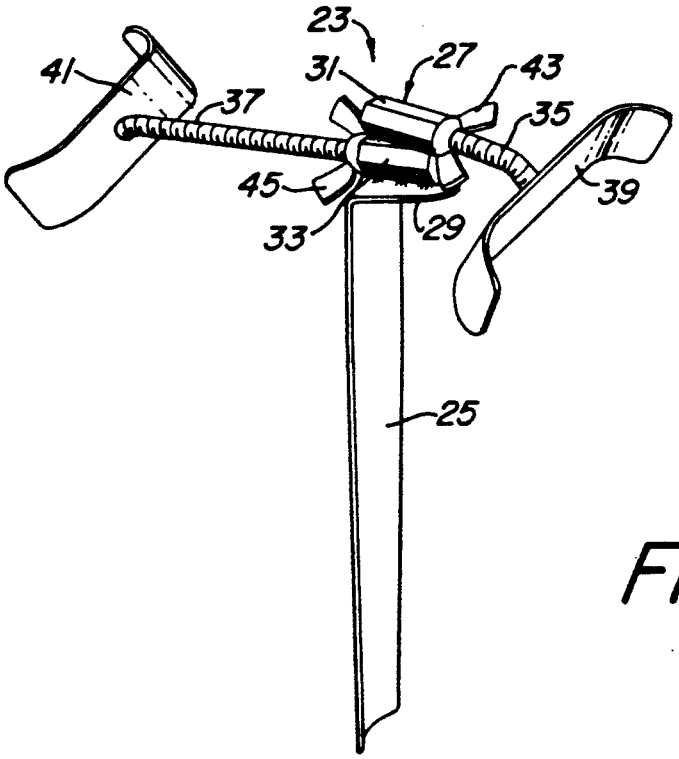
FIG. 3 is an enlarged perspective view of the golf instructional device of FIG. 1.

As best seen in the perspective view of FIG. 3, the instructional device or trainer has a support member 25 in the form of an arcuate gripper plate adapted to be held against and parallel to the grip 21 of the club 19 by a practicing golfer.

A coupler 27 is secured to a cap 29 that extends laterally from the upper end of the support member 25 to engage the upper end of the grip 21. The coupler 27, in this instance, has upper and lower hexagonal nuts or collars 31, 33 (see FIG. 3), each with a threaded opening (not shown). Threaded into each hexagonal collar 31, 33 is a respective link 35, 37 of adjustable length, each being threaded for rotation to a selected position in the threaded opening of the receiving collar. Secured to respective ends of the links 35, 37 is an arm pad 39, 41 to engage and position, as shown in FIGS. 1 and 2, the forearms, wrists and hands of the golfer.

Thus, the support member 25 is adapted to be held against and parallel to the grip 21 of the club 19 by the practicing golfer. The coupler 27 is secured to the upper end of the support member 25, and the first link 35 has one end connected to the coupler and the other end extending from the coupler a selected distance transversely from the support member. A first arm pad 39 is secured to the first link 35 to position the golfer's left arm, wrist and hand to the grip and club in an unalterable position.

A second link 37 has one end connected to the coupler 27 and the other end extending from the coupler a selected distance transversely from the support member opposite the first link 35. A second arm pad 41 is secured to the second link 33 to position the right arm, wrist and hand of the golfer relative to the grip and club in an unalterable position.

Each of the links 35, 37 has an adjustable length because of the threaded connection with the interior threaded opening of the upper and lower hexagonal nuts 31, 33 of the coupler 27. A jam nut, here in the form of a wing nut 43, 45 is used to fix the position and length of the associated link once the selected length is established.

Before practice, the length of each link 35, 37 is adjusted to match the physical characteristics of the golfer. The arm pads 39, 41 extend transversely from the upper end of the gripper plate 25 when the hands are used to hold the gripper plate 25 against the grip 21 to establish an unalterable position of the forearms, wrists and hands with respect to the grip 21 and club 19. This necessitates the use of only arm movement during a putting stroke, and further, establishes one relationship of both arms with respect to the grip 21 and club 19. This eliminates wrist movement and relative movement between the arm, with increased accuracy.

Figure 4:
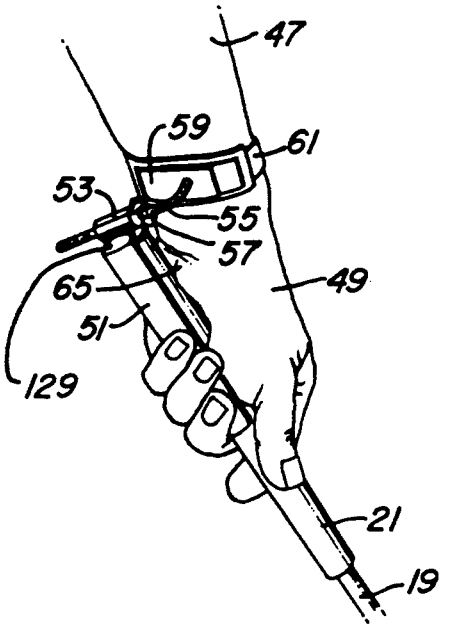
FIG. 4 is a perspective view of the left hand of a golfer holding the golf instructional device of the present invention used as a chipping trainer.
Figure 5:
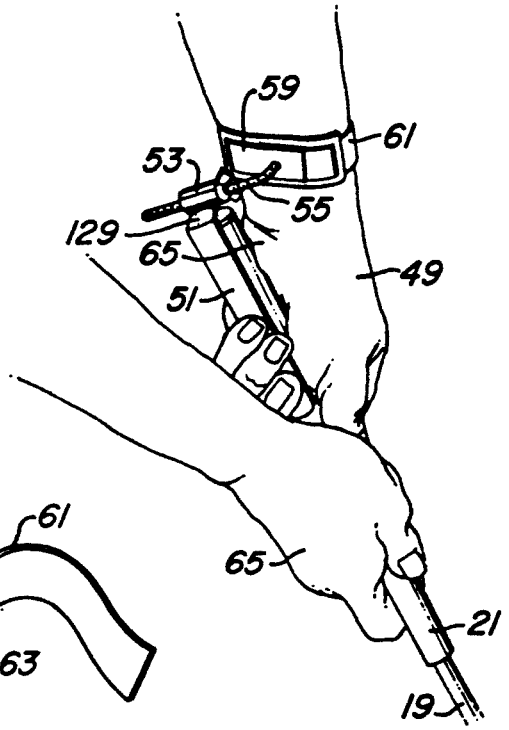
FIG. 5 is a perspective view of both hands of a golfer using the chipping training device of FIG. 4.
Figure 6:
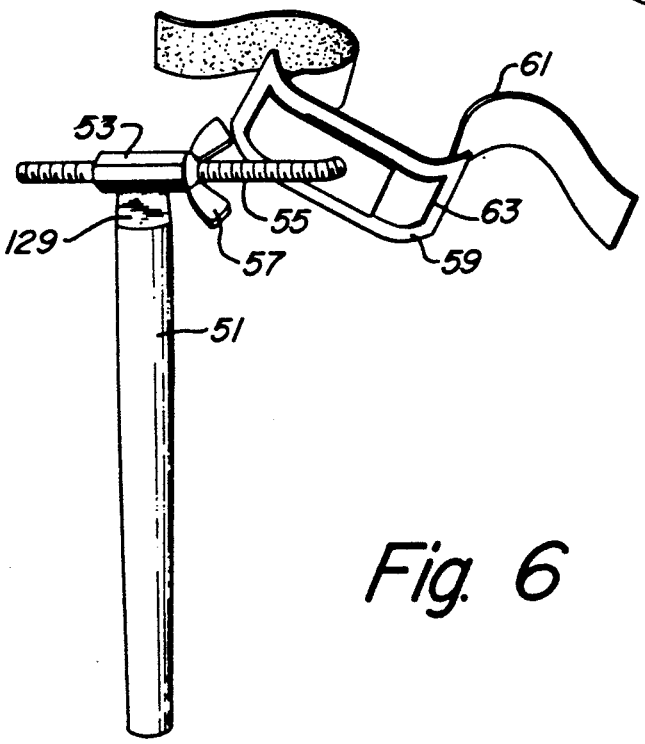
FIG. 6 is a side elevational view of the chipping training device of FIGS. 4 and 5.

FIGS. 4, 5, and 6 illustrate the use of the invention in another form as a chipping trainer. In FIG. 4 is illustrated the left forearm 47 of a golfer and the left hand 49. The left hand is shown with three fingers grasping the support member or gripper plate 51 in a parallel relationship with respect to the grip 21 of club 19. Extending from the upper end of gripper plate 51 is a coupler 53 secured to cap 129 having an interior threaded opening (not shown) to receive a threaded bolt 55, the length of which can be adjusted by rotation of the bolt and fixed by the wing nut 57. The opposite end of the bolt is secured to an arm pad 59, which has a strap 61 that extends through a plurality of slots 63 to be secured around the wrist of the golfer and held with "Velcro" or other suitable fastener means.

In FIG. 5 the golfer is shown with both hands 49, 65 on the grip 21 of club 19. The position of the arm pad 59 in relation to the grip 21 necessitates that the golfer uses the left hand 49 such that grip extends diagonally across the hand and engages the pad 65 of the hand, which is the appropriate grip for chipping or pitching. There is only one arm pad used on the left arm and none on the right arm to permit rotational movement of the arms during the swing.

There should be no rotational movement of the arms in a putting stroke, which is eliminated by the use of two arm pads as shown in FIGS. 1-3. Also, as indicated in FIG. 2, the use of the two pads positioned as indicated causes the golfer to grip the club in the life line, which is appropriate for putting.

Thus, the use of two pads, one for each arm as shown in FIGS. 1-3 causes the golfer to use the proper putting grip and reduces movements between the arms and movement of the wrists to produce an accurate putting stroke. The use of one pad as shown in FIGS. 4-6 causes the golfer to use the grip appropriate for this stroke and eliminates angular movement of the left arm and wrist relative to the grip 21.

While I have shown my invention in only two of its forms, it should be apparent to those skilled in the art that it is not thus limited but is susceptible to various changes and modifications without departing from the spirit thereof.

I claim:

1. A golf instructional device for use with a conventional golf club and grip to teach and reinforce the touch and feel of strokes that establish accurate paths of golf balls around the greens, comprising:

a elongate support member adapted to be held against and parallel to the grip of the club for use by a practicing golfer, the practicing golfer having a leading arm and a trailing arm, the support member including a cap at an upper end thereof, the cap for engagement with an upper end of the grip of the club;

a coupler secured to the cap;

a link with one end connected to the coupler and the other end extending from the coupler a selected distance transversely from and at substantially a right angle to the support member;

an arm pad secured to the link to position the golfer's lower leading arm relative to the grip and club in an unalterable position to prevent wrist movement and associated inaccuracy in the path of a struck ball.

2. The invention defined by claim 1 wherein the coupler has a threaded opening and the link has its connected end in mating threaded connection therewith.

3. The invention defined by claim 2 which further comprises a jam nut on the threaded portion of the link to engage the coupler and maintained the selected distance between the coupler and the arm pad.

4. The invention defined by claim 3 wherein the support member is an elongated gripper plate to extend from a mid region of the grip, for confinement by the golfer's hand, to the upper end of the grip.

5. A golf instructional device for use with a conventional golf club and grip to teach and reinforce the touch and feel of strokes that establish accurate paths of golf balls around the greens, comprising:

a support member adapted to be held against and parallel to the grip of the club for use by a practicing golfer, the practicing golfer having a leading arm and a trailing arm, the support member including a cap at an upper end thereof, the cap for engagement with an upper end of the grip of the club;

a coupler secured to the cap;

a link of adjustable length with one end connected to the coupler and the other end extending from the coupler a selected distance at substantially a right angle to the support member;

an arm pad secured to the link at selected angle thereto to position the golfer's lower leading arm relative to the grip and club in an unalterable position to prevent wrist movement and associated inaccuracy in the path of a struck ball.

6. The invention defined by claim 5 wherein the coupler has a threaded opening and the link has its connected end in mating threaded connection therewith.

7. The invention defined by claim 5 which further comprises a jam nut on the threaded portion of the link to engage the coupler and maintained the selected distance between the coupler and the arm pad.

8. The invention defined by claim 7 wherein the support member is an elongated gripper plate to extend from a mid region of the grip, for confinement by the golfer's hand, to the upper end of the grip.

9. A golf instructional device for use with a conventional golf club and grip to teach and reinforce the touch and feel of strokes that establish accurate paths of golf balls around the greens, comprising:

a support member adapted to be held against and parallel to the grip of the club for use by a practicing golfer, the practicing golfer having a leading arm and a trailing arm, the support member including a cap at an upper end thereof, the cap for engagement with an upper end of the grip of the club;

a coupler secured to the cap;

a link of adjustable length with one end connected to the coupler and the other end extending from the coupler a selected distance at substantially a right angle to the support member;

an arm pad secured to the link at a selected angle to position the golfer's lower leading arm relative to the grip and club in inalterable position to prevent wrist movement and associated inaccuracy in the path of a struck ball.

10. The invention defined by claim 9 wherein the coupler has a threaded opening and the link has its connected end in mating threaded connection therewith.

11. The invention defined by claim 10 which further comprises a jam nut on the threaded portion of the link to engage the coupler and maintained the selected distance between the coupler and the arm pad.

12. The invention defined by claim 11 wherein the support member is an elongated gripper plate to extend from a mid region of the grip, for confinement by the golfer's hand, to the upper end of the grip.

* * * * *